US011021899B1

(12) United States Patent
Tirado

(10) Patent No.: US 11,021,899 B1
(45) Date of Patent: Jun. 1, 2021

(54) HINGE LOCK

(71) Applicant: William Tirado, San Antonio, TX (US)

(72) Inventor: William Tirado, San Antonio, TX (US)

( * ) Notice: Subject to any disclaimer, the term of this patent is extended or adjusted under 35 U.S.C. 154(b) by 0 days.

(21) Appl. No.: 17/096,634

(22) Filed: Nov. 12, 2020

(51) Int. Cl.
*E05D 11/06* (2006.01)
*E05D 11/10* (2006.01)

(52) U.S. Cl.
CPC ..... *E05D 11/1014* (2013.01)

(58) Field of Classification Search
CPC ..... Y10T 16/61; Y10T 16/551; E05D 11/06; E05D 11/10; E05D 11/1007; E05D 11/1028; E05D 11/1014; E05D 11/0054; E05D 2011/10; E05D 2011/1028; E05D 2011/1092; E05Y 2201/218; E05Y 2201/224; E05Y 2900/132; E05F 5/06; E05C 17/00; E05C 17/025
See application file for complete search history.

(56) References Cited

U.S. PATENT DOCUMENTS 3,918,121 A * 11/1975 Williams ..... E05D 11/1007 16/319
5,560,080 A * 10/1996 Reed ..... E05D 11/0018 16/374
5,642,910 A * 7/1997 Betherum ..... E05C 17/025 16/319
5,711,560 A 1/1998 Gilbertson
5,881,431 A * 3/1999 Pieper, II ..... E05D 11/06 16/374
6,513,778 B2 2/2003 Hefley et al.
6,702,341 B1 * 3/2004 Hudelson ..... E05D 11/0018 292/288
7,506,905 B1 3/2009 George
9,988,833 B2 * 6/2018 Powell ..... E05F 5/02
2002/0129464 A1 * 9/2002 Davis ..... E05D 11/0054 16/250
2009/0211055 A1 * 8/2009 Shinall ..... E05D 11/06 16/82
2012/0186041 A1 * 7/2012 Stots ..... E05D 11/1007 16/250
2014/0103668 A1 4/2014 Mckinney
(Continued)

FOREIGN PATENT DOCUMENTS

WO WO2006076818 7/2006

OTHER PUBLICATIONS

Name: Amazon.com Product: Wedge-It WEDGE-It-1 The Ultimate Door Stop, Lime Green Website:https://www.amazon.com/Wedge-WEDGE-Ultimate-Door-Green/dp/B00N4M2UCM/ref=asc_df_B00N4M2UCM/?tag=hyprod-20&linkCode=df0&hvadid=167140177670&hvpos=hvnetw=g&hvrand=13258666440856344482&hvpon, date not available.
(Continued)

*Primary Examiner* — Chuck Y Mah
(74) *Attorney, Agent, or Firm* — Lamon Patent Services; Cynthia S. Lamon

(57) ABSTRACT

A hinge lock comprising an rectangular elongate body having dimensions including a height, width and depth formed by a rear planar rectangular wall joining two opposing planar rectangular walls along opposing long edges and a top enclosed end. An open front channel is formed and an open bottom end are formed by the joined planar walls and the top, thereby enabling the elongate body to be slid into position over a pivot portion connecting two wall plates of a closed hinge assembly.

7 Claims, 4 Drawing Sheets

(56) References Cited

U.S. PATENT DOCUMENTS

2014/0175814 A1 6/2014 Holsopple
2017/0335608 A1* 11/2017 Ching ..... E05C 19/184

OTHER PUBLICATIONS

Name: touchboards.com Product: Bully Brake Temporary Lock Clip for Doors Website: https://www.touchboards.com/bald-bb516-accessories-(universal)/?Source=googleshopping&gclid=CjwKCAjw74b7BRA_EiwAF8yHFA_olKkj7ZD98GDpQ8ydO_Bcz9wyFleMC8k_xlzkl5MZwysqEN10NBoCf4UQAvD_BwE, date not available.
Name: ebay.com Product: The Door Bull—Door Barricade Lock Out Security Device, Add Extra, High Securit Website: https://www.ebay.com/i/283982839871?chn=ps&mkevt=1&mkcid=28 Publication Date: © 1995-2020.
Name: northridge4x4.com Product: Tuffy Security Security Door Lockers Website: https://www.northridge4x4.com/part/door-mirror-accessories/037-01-tuffy-security-security-door-lockers Publication Date: © 2020.

* cited by examiner

Section A-A

HINGE LOCK

BACKGROUND OF THE INVENTION

1. Field of the Invention

The present invention is in the field of security hardware including doors and windows.

2. Discussion of the State of the Art

Closures, such as doors and windows, generally are confined to two types, sliding and hinge wall plates. In the hinge wall plate type closures a hinge system connects a fixed frame and a hinge plate connected to a wall panel. The hinge system generally consists of two or three hinges and sometimes more. In order to lock the window or door a latch or doorknob or a bolt is installed between the wall panel and the fixed frame. A second layer of protection may be desired as locks can be picked, or fail. In some cases, especially on doors that are interior to a building, such as bedroom doors, the knobs or latches do not have a locking feature. At times there may be a need for the people inside a room to stop entry into the room. Generally, this is accomplished by placing objects, for example a wedge at the bottom of the door, which may be pushed away. But these methods are not practical or reliable.

Therefore, what is clearly needed is a security device that may be easily implemented without using tools or additional hardware that solves the above limitations.

SUMMARY OF THE INVENTION

The problem stated above needs a simple solution. The inventor therefore considered a functional tool to provide a reliable door locking device that is easy to use. Accordingly, in an embodiment of the present invention a hinge lock may be provided comprising an rectangular elongate body having dimensions including a height, width and depth formed by a rear planar rectangular wall joining two opposing planar rectangular walls along opposing long edges and a top enclosed end. In this embodiment, an open front channel and an open bottom end may be formed by the joined planar walls and the top, thereby enabling the elongate body to be slid into position over a pivot portion connecting two wall plates of a closed hinge assembly.

One embodiment includes an inner volume formed within the elongate body having an inner curved top engaging with a top end of a hinge. One embodiment provides that the open front channel has may include a channel width less than the width. In this embodiment, the channel width is formed by a fourth and fifth wall that may extend orthogonally from a front elongate edges of the two opposing walls. The lock secures a hinge in place by a width of the channel just engaging two wall plates forming the pivotable portion of the hinge, thereby holding the pivotable portion of the hinge assembly in a closed position securing a door or window, for example.

DETAILED DESCRIPTION

Figure 1:
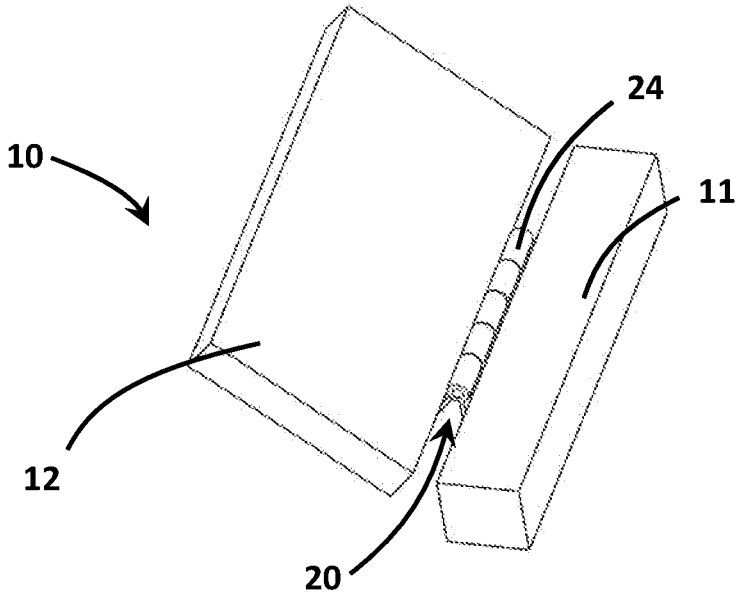
FIG. 1 is a perspective view of a closure system in a partially open position.
Figure 2:
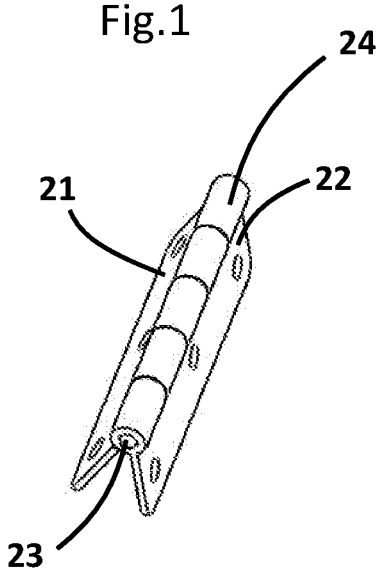
FIG. 2 is a perspective view of the hinge assembly.

The present invention provides a lock at the hinge assembly of a closure system 10 shown in FIG. 1. The door, window or other hinged apparatus, partially shown, comprises a fixed frame 11 and a door 12 pivotably attached through a hinge assembly 20. The hinge assembly comprises two hinge plates 21 and 22 rotatably attached through an axis pin 23 inserted through a cylindrical portion 24 formed by the two hinge plates 21 and 22 as shown in FIGS. 1 and 2.

Figure 3:
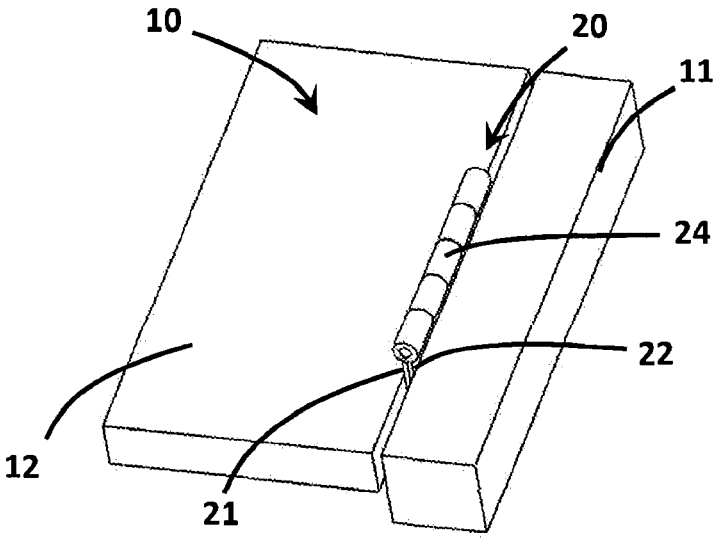
FIG. 3 is a perspective view of a closure system in a fully closed position.

FIG. 3 shows the closure assembly 10 in a closed position with hinge plate 22 attached by any known means to the fixed frame 11 and hinge plate 21 is attached to the door 12 in a same manner. The hinge is oriented such that the cylindrical portion 24 of the hinge assembly is out and away from the inside surface of the frame 11 and the door 12. When the door is closed the cylindrical portion 24 of the hinge assembly is accessible from the inside of a given room or space.

Figure 4B:
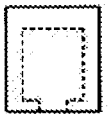
FIG. 4B is a top view of the hinge lock.
Figures 4A, 4D:
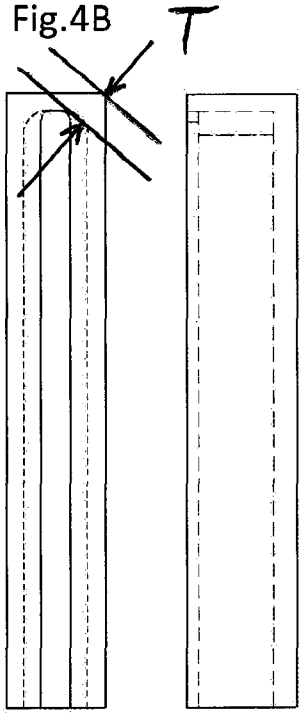
FIG. 4A is an elevation view of the hinge lock.
FIG. 4D is a side view of the hinge lock.
Figure 4E:
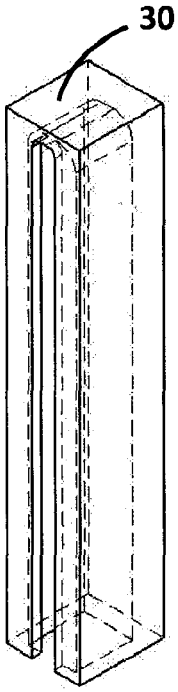
FIG. 4E is a perspective view of the hinge lock.
Figure 4C:
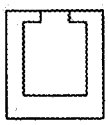
FIG. 4C is a bottom view of the hinge lock.

FIG. 4A is a front view of hinge lock 30. FIG. 4B shows a top view of the hinge lock and FIG. 4C shows an open bottom view. A side view is shown in FIG. 4D. FIG. 4E is a perspective view showing an inner volume formed by planar inner walls joined at the top of the device forming an inner radius extending to the outer planar walls and a planar outer top. In this embodiment the top is planar at the outer top and includes a thickness enabling the inner radius. Hinge lock 30 may be typically made with a hard and strong material such as hardened steel, carbon steel, stainless steel, boron alloy steel, boron carbide and molybdenum alloy steel. The hinge lock's front face of FIG. 4A has a formed slot centered on the front face along its length. An inner volume, along with the slot is enabled to accept both hinge plates 21 and 22 when the closure assembly is in a closed position, thereby holding the hinge assembly in a closed position.

Figure 5:
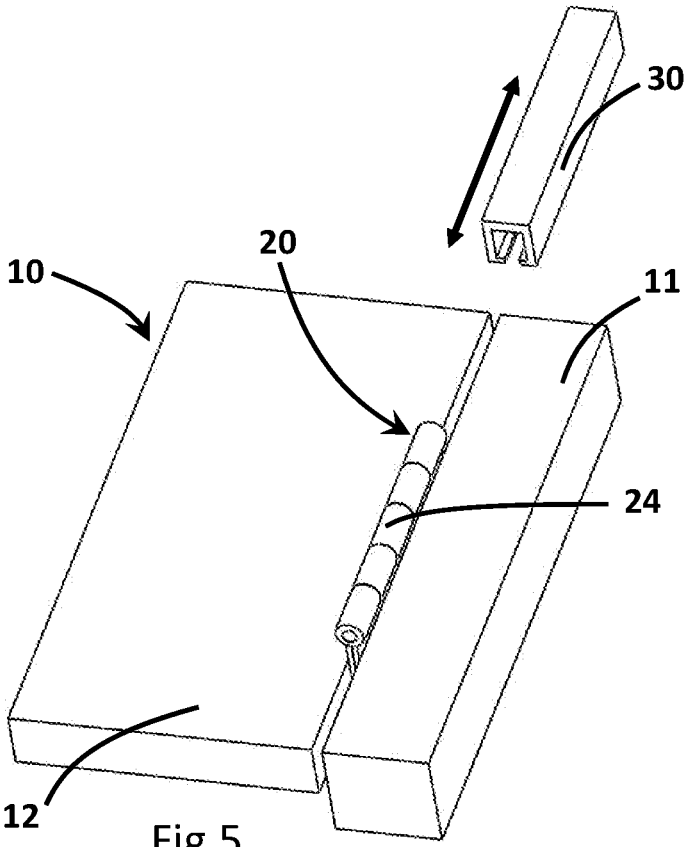
FIG. 5 is a perspective view of a closure system in a fully closed position with the hinge lock installed.
Figure 6:
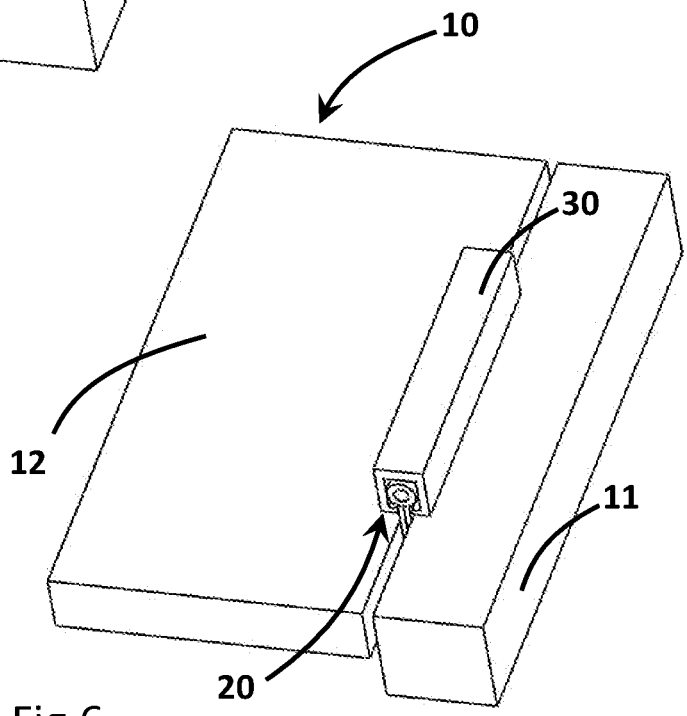
FIG. 6 shows orthogonal views of the hinge lock.

The lock can be slid up and down, as indicated by the directional arrow, over the cylindrical part 24 and hinge plates of the hinge assembly 20 as shown in FIG. 5. FIG. 6 shows the hinge lock in a locked position with the top of the hinge lock closed, it rests on a top of the cylindrical portion 24. The only way that the hinge lock can be released from the cylindrical portion 24 is by sliding it upwards.

Figure 7:
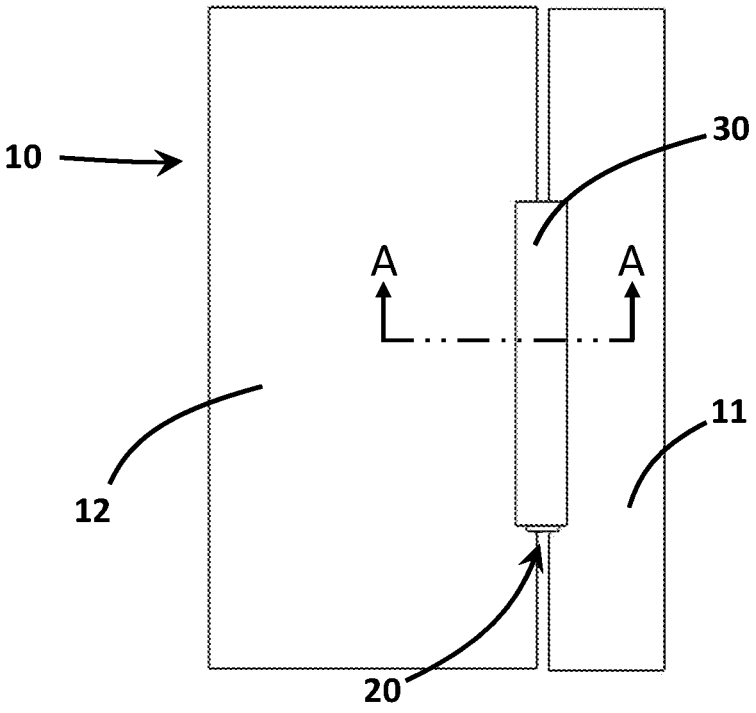
FIG. 7 is an elevation view of a closed door with the hinge lock installed.

FIG. 7. shows an elevation view of the door assembly with the hinge lock 30 installed over the hinge assembly 20. Users realize the aesthetic advantage of using hinge lock 30 which is easily placed over hinge assemblies when one enters a room and shuts the door, thereby providing added security.

Figure 8:
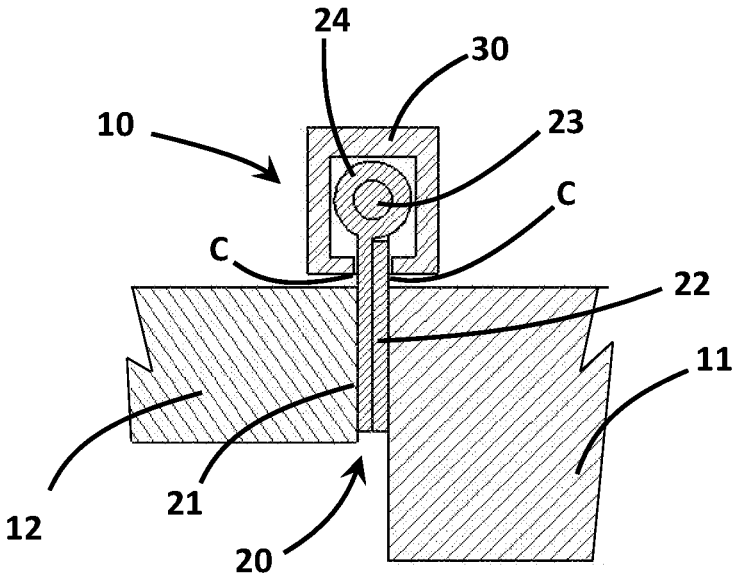
FIG. 8 is a section view through A-A of FIG. 7.

FIG. 8. is a scaled up view of section A-A of FIG. 7. The hinge lock 30 is closely encompassing and may be adjacent to the cylindrical portion 24 of the hinge assembly with a clearance C, the gap between the hinge lock 30 and the hinge wall plates 21 and 22 may be as small as possible. In one embodiment, there may be no gap C. This will keep the hinge wall plates 21 and 22 close together, or adjacent, thereby preventing the door from opening. One with skill in the art understands that hinges come in different sizes and may be used in both residential and commercial construction. Hinge lock 30 may therefore be manufactured in like sizes to fit a specific hinge or a variety of hinges.

It will be apparent to the skilled person that the implementations illustrated and described in this application are exemplary only, and not limiting to the scope of the invention. There are many variations that may be made in the examples described, all within the scope of the invention. For example, when the door 12 is forced opened while the hinge lock is in place the force is exerted on the screws that fasten the hinge wall plates 22 to the frame 11 in a direction perpendicularly away from the engagement face of the frame 11. In this situation, the side face of the hinge lock 30 towards the frame may be thickened significantly. This extension may shift the fulcrum, the contact point of the hinge lock 30 on the face of the frame 11, away from the hinge assembly 20 on the surface of the frame whereby the forces on the screws will be more of a shear force rather than a pull out force.

As is clearly seen in FIGS. 4A, 4E and 8, a thickness (T) at the top end wall of lock 30, from an inner surface of the curve in the radial direction to the corners defined by intersection of the outer surface of the upper end wall and the outer surface of the opposing planar rectangular walls, is greater than a thickness the rear wall. A thickness of the rear wall is greater than a thickness of the two opposing side walls, and a thickness of the two opposing side walls is greater than a thickness of the front walls forming the channel or slot.

There are many other alterations that might be made within the scope of the invention, and the invention may be practiced incorporating any or all of the examples described, singly or in combination. The invention is limited only by the scope of the claims that follow.

What is claimed is:

1. A hinge lock comprising:

a rectangular elongate body having dimensions including a height, width and depth formed by a rear planar rectangular wall having a first thickness, including an outer surface and an inner surface, joining two opposing planar rectangular side walls along opposing long edges, each of the opposing planar rectangular side walls having a second thickness and an outer and inner surface, and an upper enclosed end wall having a third thickness including a planar outer surface and a curved inner surface top;

wherein an open front channel and an open bottom end are formed by the joined planar walls and the upper enclosed end wall, thereby enabling the elongate body to be slid into position over a pivot portion connecting two wall plates of a closed hinge assembly, and the inner surfaces of the two opposing planar rectangular side walls extend towards the upper end wall and merge to form the curved inner surface top, and wherein the thickness at the upper end wall, from the curved inner surface in a radial direction to a corner defined by intersection of the outer surface of the upper end wall and the outer surface of the side wall, is greater than the thickness of the rear wall.

2. The hinge lock of claim 1, wherein an inner volume is formed within the elongate body and the outer surfaces of the rear planar rectangular wall, and the two opposing planar rectangular side walls extend upwards and meet the planar outer surface of the upper enclosed end wall at substantially right angles.

3. The hinge lock of claim 1, wherein the open front channel has a channel width less than the width of said elongated body.

4. The hinge lock of claim 3, wherein the channel width is formed by two planar front walls respectively extending orthogonally from front elongate edges of the two opposing side walls, each of the planar front walls having an inner surface, an outer surface and a fourth thickness, and the inner surfaces of the planar front walls extend towards the upper enclosed end wall to form the curved inner surface top.

5. The hinge lock of claim 4, wherein the second thickness of the side walls is greater than the fourth thickness of the front walls.

6. The hinge lock of claim 1, wherein the first thickness of the rear wall is greater than the second thickness of the side walls.

7. The hinge lock of claim 1, wherein the third thickness of the upper end wall is greater than the first thickness of the rear wall.

* * * * *